United States Patent [19]

Saurwein

[11] 4,078,766

[45] Mar. 14, 1978

[54] POWERED NAIL EXTRACTOR

[76] Inventor: Albert C. Saurwein, 19702-37th Pl. S., Seattle, Wash. 98188

[21] Appl. No.: 786,237

[22] Filed: Apr. 11, 1977

[51] Int. Cl.[2] ..... B25C 11/00

[52] U.S. Cl. ..... 254/18

[58] Field of Search ..... 254/18; 29/252

[56] References Cited

U.S. PATENT DOCUMENTS

| | | | |
|---|---|---|---|
| 2,709,570 | 5/1955 | Henry | 254/18 |
| 3,883,118 | 5/1975 | Miller | 254/18 |

*Primary Examiner*—Robert C. Watson

*Attorney, Agent, or Firm*—Christensen, O'Connor, Johnson & Kindness

[57] ABSTRACT

A fluid actuated nail extractor includes a pair of jaws pivotally mounted on a reciprocable rod. An impact piston impacting a second rod coupled to the jaws closes the jaws about a nail embedded in a workpiece when the extractor is positioned adjacent the nail. Thereafter, a second piston actuates the reciprocable rod to extract the nail from the workpiece. Pressurized fluid, controlled by a plurality of poppet valves, drives the pistons through a predetermined sequence of operations. The entire sequence of operations is dependent upon the position of a safety valve that is actuated by a push rod having an end located adjacent the jaws. The push rod is actuated only when the nail extractor is positioned adjacent the workpiece, and hence actuating the safety trigger valve so that the operational sequence of the pistons can be initiated.

25 Claims, 12 Drawing Figures

POWERED NAIL EXTRACTOR

BACKGROUND OF THE INVENTION

The present invention relates to nail extractors, and more particularly to a fluid actuated nail extractor employing novel nail engaging jaws, novel actuating and extracting mechanism coupled to the jaws, and a novel pneumatic control system for the actuating and extracting mechanism.

Pneumatic nail extractors in which jaws grip a nail or spike and are pulled from a workpiece by a piston are known in the art. These devices have the advantage of exerting a linear force coaxial with the nail or spike. Because the extraction force is exerted coaxially relative to the nail, the nail is not bent during extraction, thereby preserving the nail as well as reducing the amount of pulling force required.

Where the head of a nail or spike is exposed above the workpiece, one-piece claws as shown in U.S. Pat. No. 2,797,889 to Talboys, or multi-element, spring actuated jaws as shown in U.S. Pat. No. 2,945,674 to Hursh, are feasible. Where, however, a nail head does not extend above the workpiece surface, a strong clamping action of the claws is required in order to penetrate the workpiece surface and clamp the nail. U.S. Pat. Nos. 2,570,914 to Buck, 2,709,570 to Henry, and 2,735,649 to Swallert show pneumatic nail extractors in which jaw mechanisms or jaw actuators are driven downwardly by pneumatic pistons to provide a strong clamping action to penetrate the workpiece surface. Such extractors, however, exhibit a distinct disadvantage because the strong downward action of the piston exerts a reactive force on the piston and cylinder that can cause the entire extracting tool to jump from its centered position over the nail. If this occurs, the extracting tool will not be properly positioned when the jaws are driven closed, thereby destroying the nail head or missing it entirely. Other nail extractors are known in which upward movement of pneumatic pistons cause clamping of jaws as well as upward movement of the jaws. Examples of such devices are found in U.S. Pat. Nos. 1,771,712 to Jimerson and 2,846,187 to Sublett et al. Such devices are adequate where the head of a nail or spike is above a workpiece. However, in order to prevent the jaw mechanism from rising before it is clamped about a nail, the initial piston action must be retarded in some manner, while a quick clamping action is required in order to penetrate a workpiece surface to extract a nail.

It is a broad object of the present invention to provide a pneumatically powered nail extractor that overcomes the problems discussed above. Further objects of the present invention are to provide a nail extractor that has a rapid nail clamping action while exerting a very small, if any, reactive force on the extractor that may cause the extractor to become misaligned with a nail to be pulled; to provide a relatively lightweight nail extractor that sequentially clamps the nail and thereafter extracts it with minimum effort required by the operator of the extractor; to provide a pneumatically powered extractor having a minimum number of moving parts that resets itself after each extraction cycle; to provide a nail extractor that requires a minimum maintenance effort and is relatively inexpensive to manufacture; and to provide a safety mechanism on the extractor that will normally prevent its operation when not aligned with a nail to be extracted from a workpiece.

SUMMARY OF THE INVENTION

The foregoing objects, and other objects that will become apparent to one of ordinary skill upon reading the following specification, are provided in a nail extractor comprising a support member, a nail pulling member mounted on the support member for reciprocating movement toward and away from the workpiece when the support member is operably positioned adjacent the workpiece, and first and second jaws mounted on the nail pulling member for swinging movement between a first position in juxtaposed relationship adjacent a nail embedded in the workpiece and a second position remote from the nail. The nail extractor also includes jaw actuation means for moving the jaws between the first and second positions and a drive means for driving the nail pulling member away from the workpiece. The drive means is actuated after the jaw actuation means so that the nail extractor operates sequentially to first clamp the nail and thereafter extract it from the workpiece.

More specifically, a set of pneumatically actuatable pistons mounted in separate cylinders are operatively coupled to the jaws and to the nail pulling member. A plurality of pneumatic valves are coupled to a source of pressurized fluid and are operatively coupled and associated with the pistons and cylinders to sequentially actuate first the jaws and then the nail pulling member. A manually-actuatable valve initiates the sequence of operation of the control valves while an overriding safety valve prevents actuation of the control valve unless the extractor is positioned on the workpiece, even though the manually actuated valve is placed in a condition to otherwise initiate the extraction sequence. The safety valve is actuated by a push rod that normally extends beyond the lower end of the support member adjacent the extraction jaws. When the lower end of the support member is abutted against the workpiece adjacent the nail to be extracted, the push rod is retracted, thus actuating the safety valve and allowing the control valve sequence to be initiated by actuation of the manually-actuatable trigger valve.

BRIEF DESCRIPTION OF THE DRAWINGS

A better understanding of the present invention can be derived by reading the ensuing specification in conjunction with the accompanying drawings wherein.

DETAILED DESCRIPTION

Figure 1:
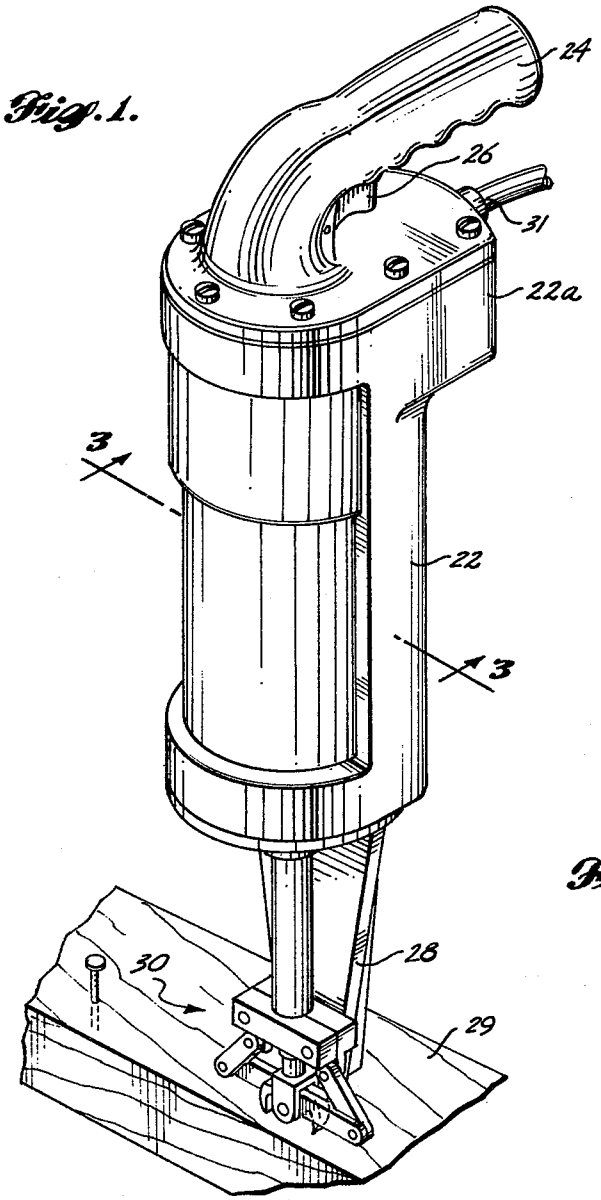
FIG. 1 is an isometric view of a preferred embodiment of the invention.

The nail extractor illustrated in FIG. 1 has a main housing 22 that supports the jaw mechanism and houses the drive assembly, comprising two pistons mounted in axially spaced cylinders. A handle 24 incorporating a manually actuated trigger 26 is affixed to the top portion of the housing 22. A support member or arm 28 extends longitudinally below the main housing of the extractor. The jaw mechanism 30 is spaced below the main housing 22 adjacent the bottom end of the support arm 28 and is mounted on an extraction rod to be described in detail below.

Figure 2:
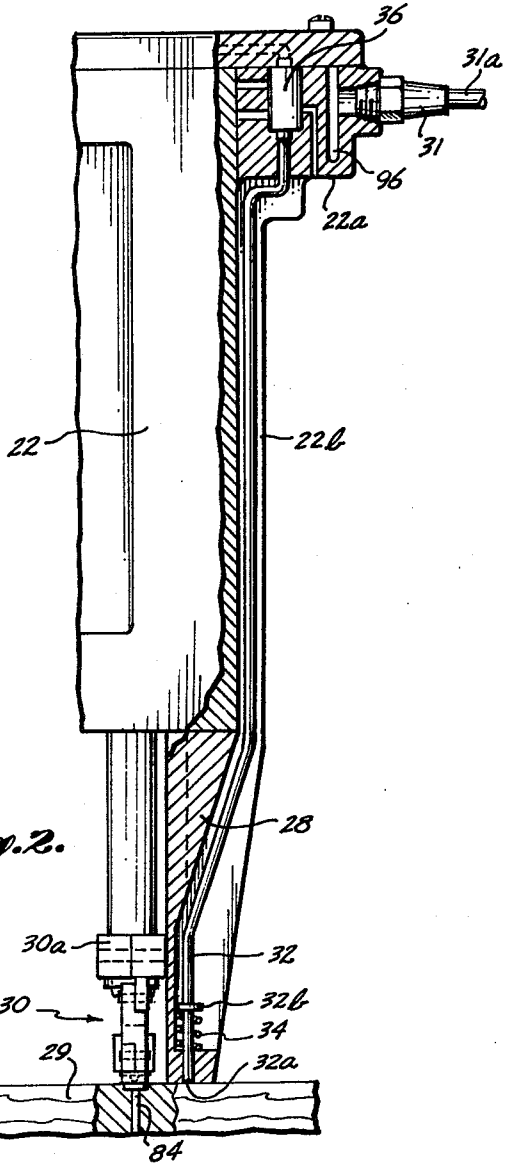
FIG. 2 is an enlarged partial side view, partially broken away, of the nail extractor shown in FIG. 1.

Referring to both FIGS. 1 and 2, a fluid coupling 31 is affixed to a lateral extension 22*a* of the main housing for coupling a pneumatic supply conduit to the main housing. The conduit is coupled in a conventional manner to a source of pressurized fluid, such as pressurized air. The lateral extension 22*a* of the main housing 22 houses a manifold cavity 96 that is coupled to a plurality of pneumatic control valves (not shown) and a pneumatic safety valve 36. The safety valve 36 is actuated by a push rod 32 that extends from the spool (not shown) of the safety valve 36 through a channel 22*b* formed on the back side of the main housing 22 and extending downwardly through the support arm 28 to a location adjacent the bottom of the support arm 28. The bottom end 32*a* of the push rod 32 normally extends below the bottom of the support arm 28. The push rod 32 is biased into this extended position (shown only in FIG. 6) by a coil spring 34 positioned in tension and between a retaining ring 32*b* attached to the push rod 32 and the bottom end of the channel 32*b* in the support arm. When the jaw mechanism 30 is positioned over a nail embedded in the workpiece 29, the bottom end of the support arm 28 first abuts the upper surface of the workpiece and, as the support arm 28 is lowered to abut the workpiece, the push rod 32 is caused to retract. When the push rod is retracted (as shown in FIG. 2) the safety valve 36 is actuated to allow the sequential operation of the drive assembly to be initiated by manipulation of the trigger 26. When, however, the nail extractor is lifted away from the workpiece, the biasing force of the spring 34 extends the push rod so that its bottom end 32*a* once again extends beyond the bottom of the arm 28. When the push rod is extended, the safety valve 36 is repositioned so as to deactivate the entire pneumatic control system. In this manner, the jaws cannot be actuated by manipulating the trigger 26, thereby preventing injury to an operator by inadvertent initiation of the control sequence. The function and operation of the safety valve 36 will be described further in conjunction with FIGS. 9 through 12 when the operation of the pneumatic control system is described in detail.

Figure 3:
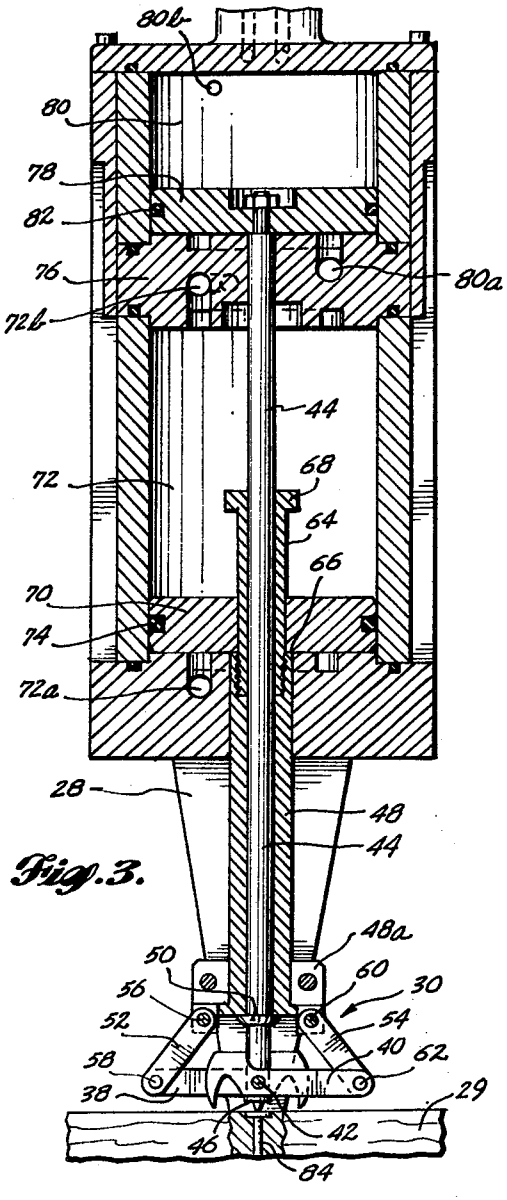
FIGS. 3 through 6 are enlarged partial longitudinal sectional views of the nail extractor taken substantially along section line 3—3 of FIG. 1, showing the sequential operation of the mechanical components of the nail extractor of the present invention.
Figure 4:
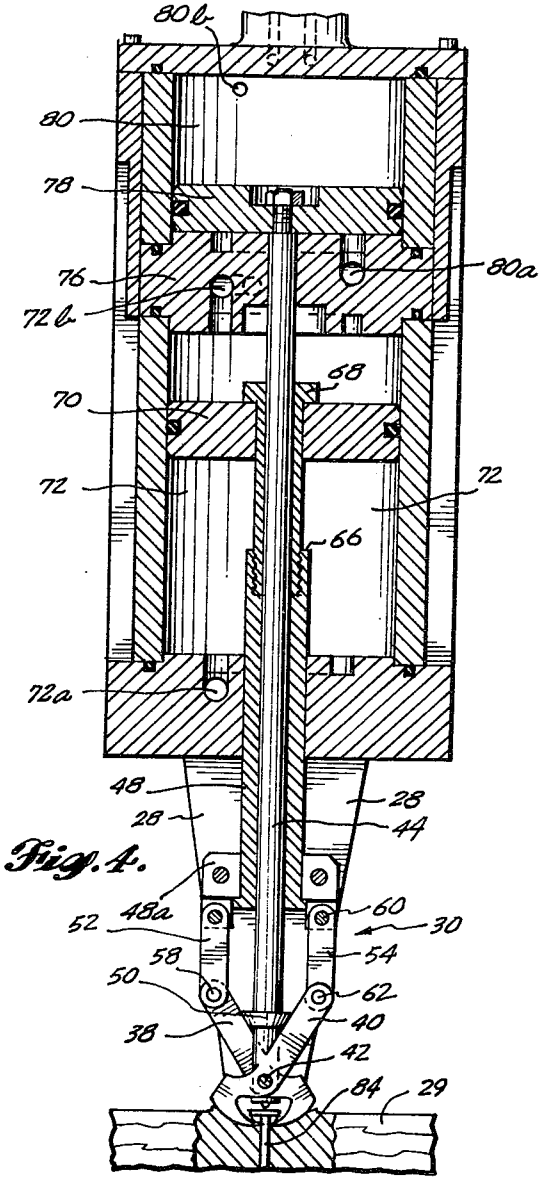

Referring to FIG. 3, the jaw mechanism 30 is shown in side elevation in its normal static position prior to use. The jaw mechanism includes first and second jaws 38 and 40 pivotally mounted about a pin 42 to a nail pulling or extraction rod 44. The jaws are pivoted to swing in a plane oriented transversely and preferably perpendicularly to the surface of the workpiece 29. The extraction rod 44 extends longitudinally upwardly into the main housing 22 of the extractor. A centering nib or pin 46 extends downwardly from the lower end of the extraction rod to a position adjacent the surface of the workpiece 29 when the bottom end of the support arm 28 abuts the workpiece surface. The centering pin, prior to use of the extractor, is positioned directly over the nail to be extrcted from the workpiece. A jaw actuation sleeve 48 is slidably mounted concentrically about the rod 44 so that the rod and sleeve can reciprocate longitudinally relative to each other. The bottom end of the sleeve abuts a shoulder or flange 50 affixed to the rod immediately above the pivot pin 42 when the extractor is in its static position. Each of the jaws 38 and 40 are positioned on opposite sides of the extraction rod and have arms that extend laterally to the respectively opposite sides of the rod. Links 52 and 54 couple respective ends of the jaw arms to a bracket 48*a* affixed to the lower end of the jaw actuation sleeve 48. The upper ends of the links 52 and 54 are pivotally coupled to the bracket 48*a* by pins 56 and 60. Pins 58 and 62 respectively couple the links 52 and 54 to the respective arms on jaws 38 and 40. During an operational sequence as the jaw actuation sleeve 48 moves upwardly relative to the extraction rod 44, links 52 and 54 will pull upwardly on the ends of the jaw arms to swing the jaws about the pivot pin 42 and cause them to enter the surface of the workpiece and clamp onto the nail 84 immediately below the nail head (as shown in FIG. 4).

A second sleeve 64 of reduced diameter is fixed in a conventional manner to the upper end of jaw actuation sleeve 48 and extends upwardly in concentric relationship about the extraction rod 44. The upper end of the reduced diameter sleeve 64 carries a circular shoulder 68 that forms an upper abutment or stop on the sleeve. The shoulder formed between the jaw actuation sleeve 48 and the reduced diameter sleeve 64 forms a second abutment or stop on the sleeve. The upper ends of the sleeve 48 and the sleeve 64 are positioned within a lower cylinder 72 provided within the main housing 22 of the extractor. An impact piston with a central cylindrical aperture is slidably mounted on the reduced diameter sleeve 64 for reciprocating movement along the reduced diameter sleeve 64 between the lower abutment formed by shoulder 66 and the upper abutment formed by the shoulder 68. A fluid seal is provided between the periphery of the piston 70 and the exterior walls of the cylinder 72 by an O-ring 74 positioned in a peripheral annular channel in the piston.

The extraction rod 44 extends upwardly above cylinder 72 through a partition 76 in the main housing and into an upper cylinder 80. The upper end of the extraction rod is affixed to an extraction piston 78 by a conventional fastener. The extraction piston 78 is mounted for reciprocating movement in the upper cylinder 80 and is provided with an O-ring seal 82 situated in an annular peripheral channel in the piston 78 similar to that in piston 70. Partition 76 separates the lower cylinder 72 from the upper cylinder 80 and carries passageways 72*b* and 80*a* through which pneumatic fluid is directed respectively to the lower portion of the upper cylinder 80 and the upper portion of the lower cylinder 72. Similar pneumatic passageways 72*a* and 80*b* are provided respectively in the lower end of the main housing 22 communicating with the lower portion of cylinder 72 and in the upper end of the main housing 22 communicating with the upper portion of upper cylinder 80.

The sequential operation of the driving pistons to actuate the clamping and extraction motion of the jaws will now be described in reference to FIGS. 3 through 6. Before the nail extractor is centered over a nail and positioned aginst the workpiece, the pneumatic system is in a static mode wherein pressurized air is admitted to the upper portions of both cylinders 72 and 80, thereby forcing the pistons 70 and 78 downwardly against the bottom of the respective cylinders 72 and 80. When the impact piston 70 is in its lower position, it abuts the shoulder 66 on the jaw actuation sleeve forcing the jaw actuation sleeve into a downward position to open the jaws 38 and 40 as shown in FIG. 3. Likewise, the extraction piston 78 forces the extraction rod 44 to a lower position so that the centering pin 46 can be positioned by the operator adjacent the nail head on the surface of the workpiece 29.

Figure 5:
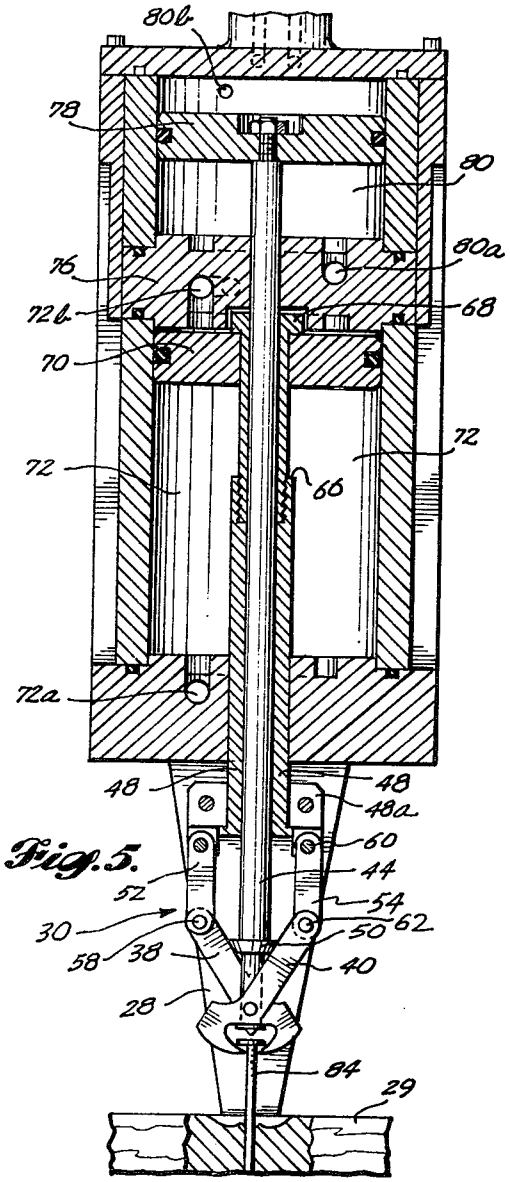

When the nail extractor is positioned against the workpiece 29 so that the bottom end of the support arm 28 abuts the workpiece surface, the push rod 32 is retracted, actuating the poppet valve 36 (FIG. 2) and activating the pneumatic control system, readying it for initiation of its control sequence by manipulation of the trigger 26 (FIG. 1). When activated, the pneumatic control system (to be described later) causes pressurized fluid to enter cylinder 72 through port 72*a* below the piston 70, thereby driving the piston upwardly along the reduced diameter sleeve 64. When the piston 70 reaches the location of the shoulder 68, the sleeve 48 is driven upwardly to the position shown in FIG. 4 thereby lifting the bracket 48*a* and consequently links 52 and 54 to swing the jaw arms upwardly and cause the jaws 38 and 40 to swing downwardly, penetrate the surface of the workpiece and grip the nail. During this first step in the sequence of operation, the air pressure is relieved from the upper portion of lower cylinder 72 through upper port 72*b*, thus allowing the piston 70 to rise upon increase in pressure in the lower portion of the cylinder 72. While piston 70 travels upwardly to close the jaws, pressure is maintained in the upper portion of the upper cylinder 80 to hold the extraction piston 78 at the lower end of its stroke. Once the jaws are closed however, pressure is relieved from the upper portion of cylinder 80 through port 80*b*. At the same time, pressurized fluid enters the lower portion of the cylinder 80 through port 80*a*, causing the extraction piston 78 to begin its upward stroke, pulling the extraction rod 44 upwardly as shown in FIG. 5. At the same time, the piston 70 forces the jaw actuation sleeve 48 upwardly and finishes its upward stroke simultaneously with the upward stroke of the extraction rod 44. Thus both pistons are pulling upwardly to nearly double the extraction force and to maintain the jaws tightly clamped about the nail 84.

Figure 6:
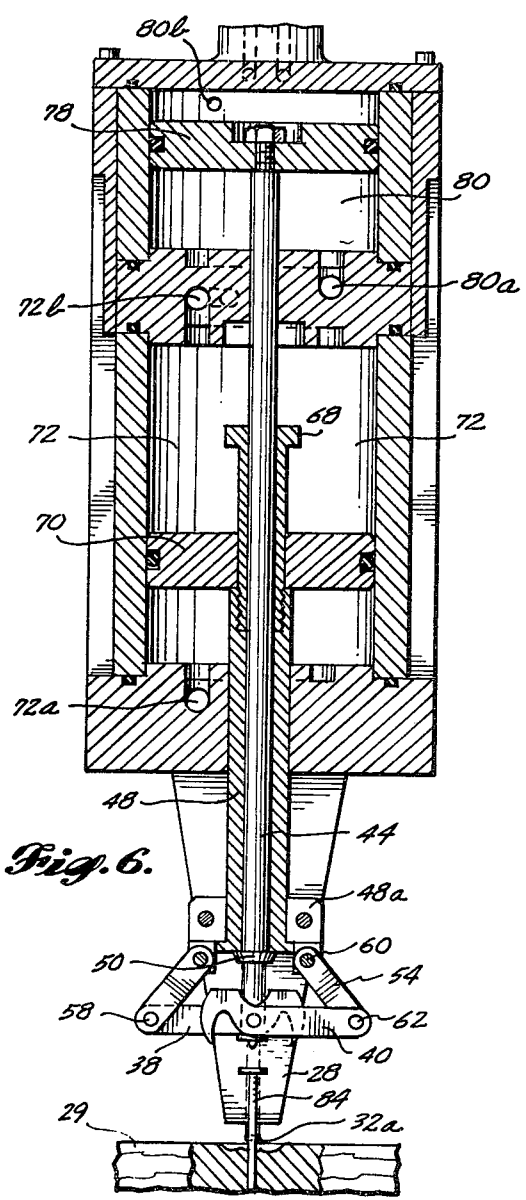

Once the nail 84 is extracted from the workpiece 29, the entire extractor can be lifted away from the workpiece to release the push rod and allow it to extend once again beyond the lower end of the support member 28. As this occurs, the safety trigger valve 36 (FIG. 2) is deactivated, returning the control valving to its normal static control mode. When the control valves are returned to the static control mode, fluid pressure is first relieved from the bottom of cylinder 72 while pressurized fluid is readmitted to the upper portion of the lower cylinder, driving the impact piston 70 downwardly against the abutment formed by shoulder 66 on the jaw actuation sleeve and forcing the sleeve downwardly to open the jaws 38 and 40 (as shown in FIG. 6). Thereafter fluid pressure is relieved from the lower portion of cylinder 80 while pressurized fluid is readmitted to the upper portion of the cylinder 80, driving the extraction piston and thus the extraction rod downwardly. The jaw mechanism is thus ready to begin another extraction sequence (as shown in FIG. 3).

Figure 7:
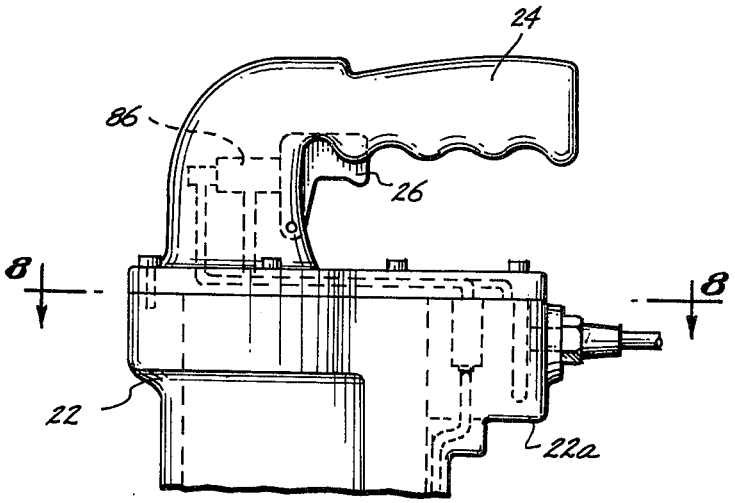
FIG. 7 is an enlarged partial side view of FIG. 1 showing the upper portion of the nail extractor including the manually-actuatable trigger mechanism.
Figure 8:
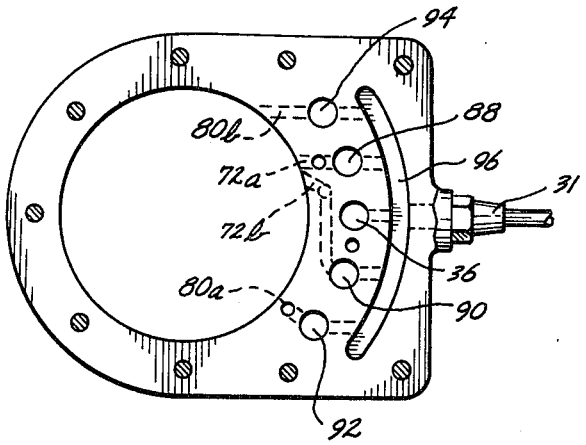
FIG. 8 is a cross-sectional view of the nail extractor taken substantially along section line 8—8 in FIG. 7.

Referring to FIGS. 7 and 8, actuation of the pistons is controlled by six poppet valves. Four of the six poppet valves controlling the driving sequence are located in bores in the lateral extension 22*a* on the upper end of the main housing 22 of the extractor. The central valve is the safety valve 36 that is coupled to the push rod 32 (FIG. 2). The manually actuatable trigger valve 86 (shown in dotted outline) is located in the handle 24 at the top of the main housing 22. The trigger valve 86 is actuated by trigger 26 swingably mounted in the handle. A first poppet valve 88 controls the flow of pressurized fluid to the lower end of the lower cylinder 72 while a second poppet valve 90 controls the flow of pressurized fluid to the upper end of the lower cylinder 72. Third and fourth poppet valves 92 and 94 respectively control the flow of pressurized fluid to the lower and upper ends of the upper cylinder 80. Pressurized fluid is supplied to the five poppet valves in the lateral extension 22*a* of the main housing from a source (not shown) through the fluid coupling 31 and into the manifold 96. For purposes of simplicity, all of the fluid channels leading to and from the control valves, the safety valve and the manually actuated trigger valve are not shown. One of ordinary skill, after reading the specification and reviewing the schematics that appear in FIGS. 9 through 12, will readily be able to design the appropriate porting for the valves to cause the extractor to operate in accordance with the present invention.

Figure 9:
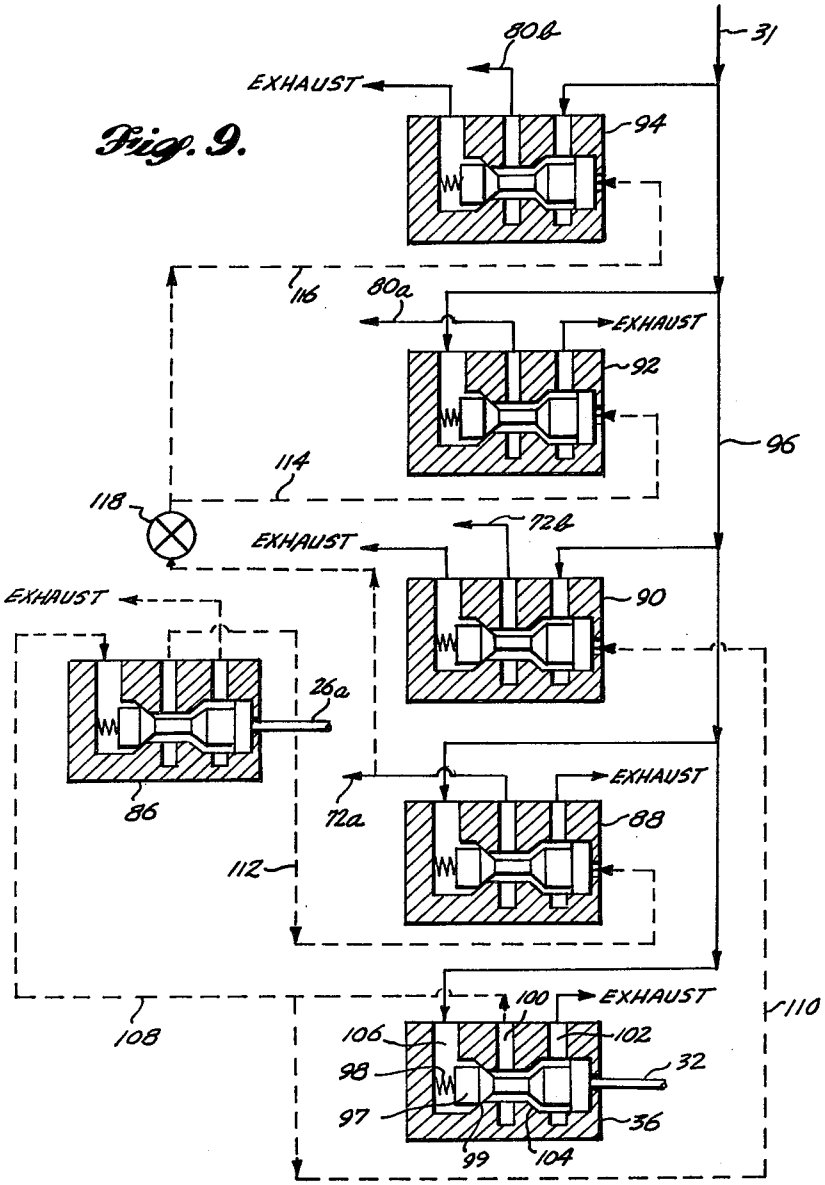

Referring now to the schematic diagrams of FIGS. 9 through 12, each of the valves, including the control valves and the safety valve and the trigger valve, is of the same design and thus only the safety valve will be described in detail. As shown in FIG. 9, a valve spool 97 is spring biased by a coil spring 98 in tension toward the right against a valve seat 99 within the valve body. When the valve element is in this position, fluid flow occurs from the central port 100 through the right hand port 102. When the valve spool 96 is moved to the left against the spring bias by push rod 32, the spool 96 seats against valve seat 104 within the valve body, closing the fluid passage between ports 100 and 102 and opening the fluid passage between left hand port 106 and central port 100. The trigger valve 86 is actuated by a force from a trigger arm 26*a* against the spool of the manual trigger valve 86. The remaining valves are actuated by pilot fluid pressure supplied via lines 110, 112, 114 and 116. With the exception of the trigger valve 86, each of the remaining poppet valves 36, 88, 90, 92 and 94 has one of its ports connected to the manifold 96 to supply pressurized fluid to the valve. A second port of each of the valves is connected to an exhaust channel and is exhausted to the atmosphere. The center port of each one of the control poppet valves 88, 90, 92 and 94 is coupled respectively to ports 72*a*, 72*b*, 80*a* and 80*b* in the lower and upper cylinders.

When the pneumatic control system of the extractor is in its static position as shown in FIG. 9 (corresponding to the mechanical view in FIG. 3), fluid is supplied through the control valves 90 and 94 to the respective upper portions of the lower and upper cylinders 72 and 80. The remaining control valves 88 and 92 exhaust the lower portions of the two cylinders to the atmosphere. The center port of the safety valve 36 is coupled to a first fluid control line that branches into lines 108 and 110. The fluid in line 110 controls the movement of the control valve 90 which in turn controls the flow of pressurized fluid to the upper portion of the lower cylinder 72. The control line 108 is coupled to the left hand inlet port of manual trigger valve 86. The central port of manual trigger valve 86 is connected to fluid control line 112 coupled to the spool of control valve 88, which in turn controls the flow of pressurized fluid to the lower portion of the lower cylinder 72. The central port of the control valve 88 in addition to being coupled to the lower end of the lower cylinder, is also coupled to a control line that branches into two control lines 114 and 116, coupled respectively to the spools of control valves 92 and 94. The control line from valve 88, prior to branching into control lines 114 and 116, contains a restrictor or orifice 118 to delay the build-up of pressure in control lines 114 and 116. The purpose of this delay in control pressure build-up will become apparent when reading the explanation in conjunction with the remaining figures. Control valves 92 and 94 respectively control the flow of pressurized fluid to the lower and upper portions of the upper cylinder 80.

Figure 10:
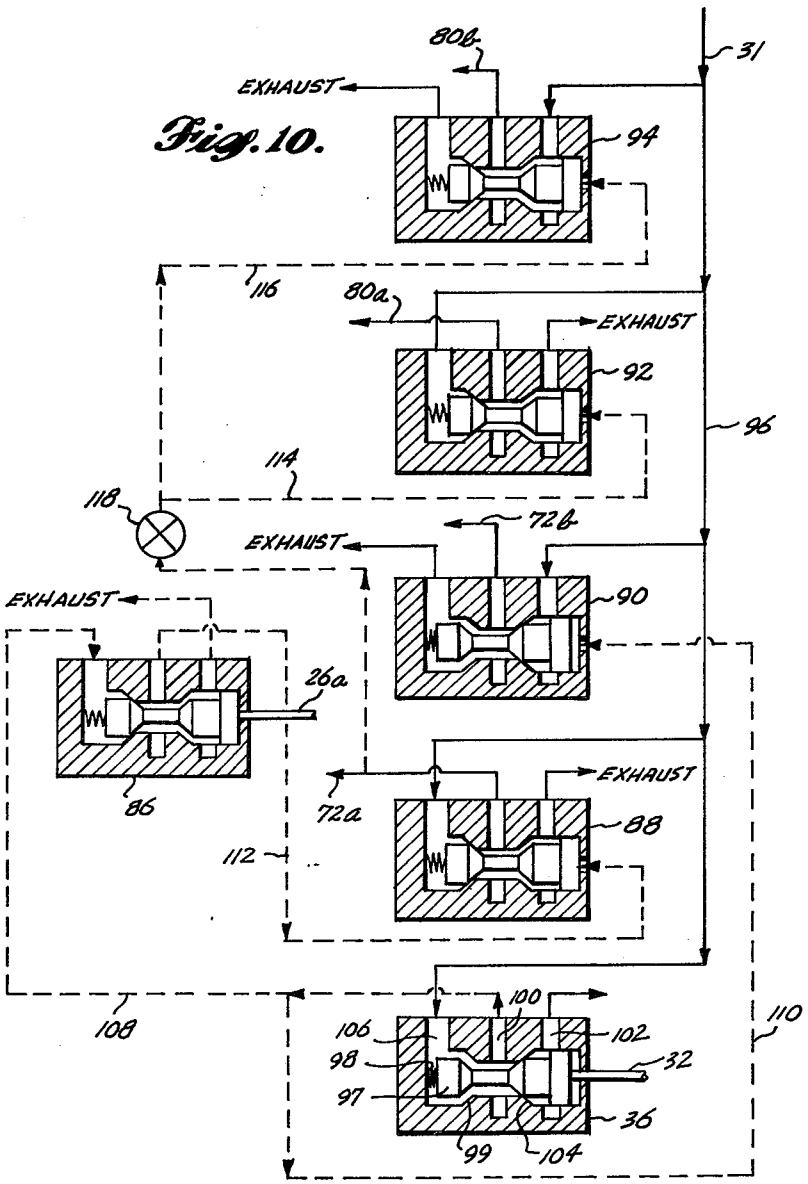
FIGS. 9 through 12 are schematic diagrams of the fluid control valves that control the flow of pressurized fluid showing the sequence of operation of the valves response to actuation of the overriding safety valve and actuation of the trigger valve to initiate the control sequence of the plurality of control valves. de

When the safety push rod 32 is actuated, the spool of the safety trigger valve 86 is moved from its static condition to a second condition as shown in FIG. 10, opening the flow of control fluid to control valve 90, which causes the spool of control valve 90 to move from its static condition to a second condition, coupling the upper portion of the lower cylinder to exhaust. When the safety trigger valve is in its second condition, pressurized control fluid is also admitted to the inlet port of the manual trigger valve 86, but no control fluid flows through that valve until the manual trigger is actuated.

Figure 11:
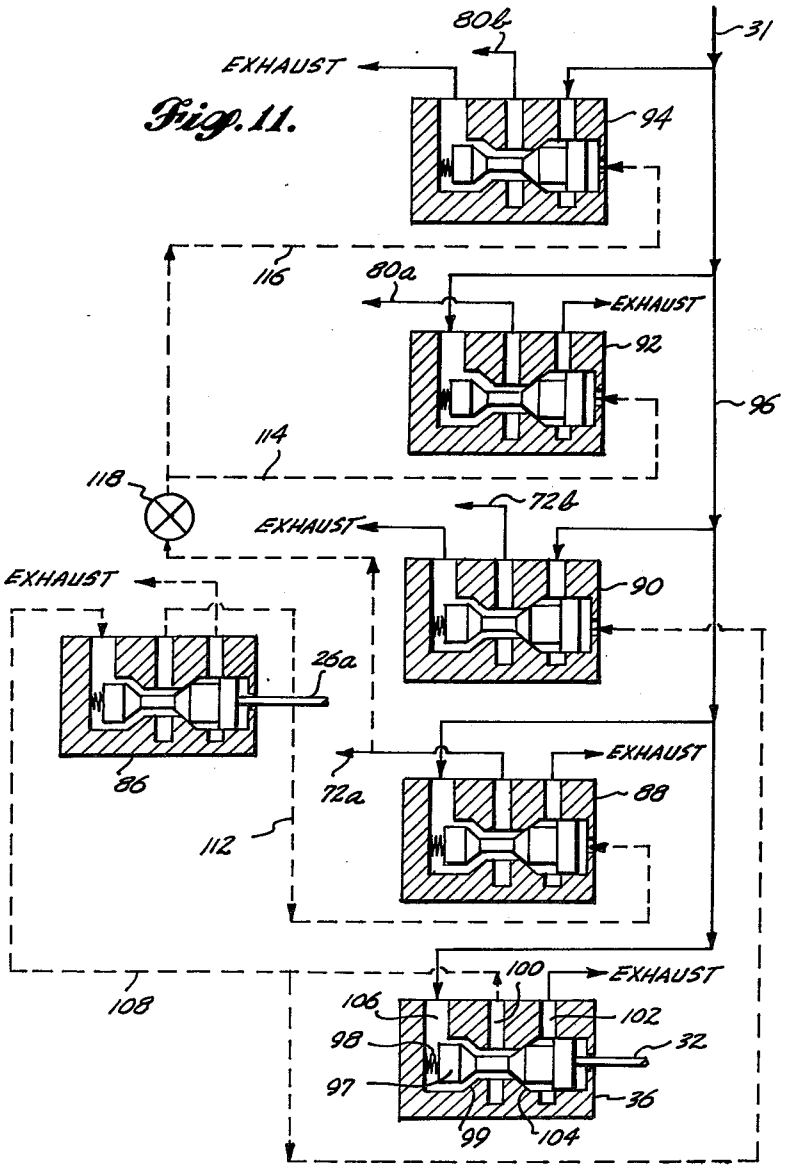

As shown in FIG. 11, when the manual trigger has been actuated to move the spool in the manual trigger valve 86 from its static condition to its second condition, control fluid passes through the trigger valve and is admitted to the control valve 88. As this occurs, the spool of control valve 88 moves from its static condition to its second condition, admitting fluid from the manifold 96 into the lower portion of the lower cylinder 72, causing the piston 72 to begin its upward stroke to impact the shoulder 68 on the jaw actuation sleeve (corresponding to the mechanical view in FIG. 4). At the same time, control fluid is admitted from the trigger valve 86 to the control line leading to the restrictor 118. The size of the restrictor is chosen to allow the piston 70 to reach the upper end of its stroke and to move actuation sleeve 48 to a position at which the jaws engage the nail before either of the remaining control valves 92 or 94 are moved from their static condition by the build-up of fluid pressure in control lines 114 and 116. After the piston 70 has reached the upper end of its stroke, the pressure build-up in control lines 114 and 116 is sufficient to move the spools in the remaining control valves 92 and 94 from their static condition to their second condition. As this occurs, control valve 92 admits pressurized air to the lower portion of the upper cylinder 80 while control valve 94 exhausts the upper end of the upper cylinder 80 to the atmosphere. As this occurs, both pistons 70 and 78 complete their upward stroke, completing extraction of the nail from the workpiece.

Figure 12:
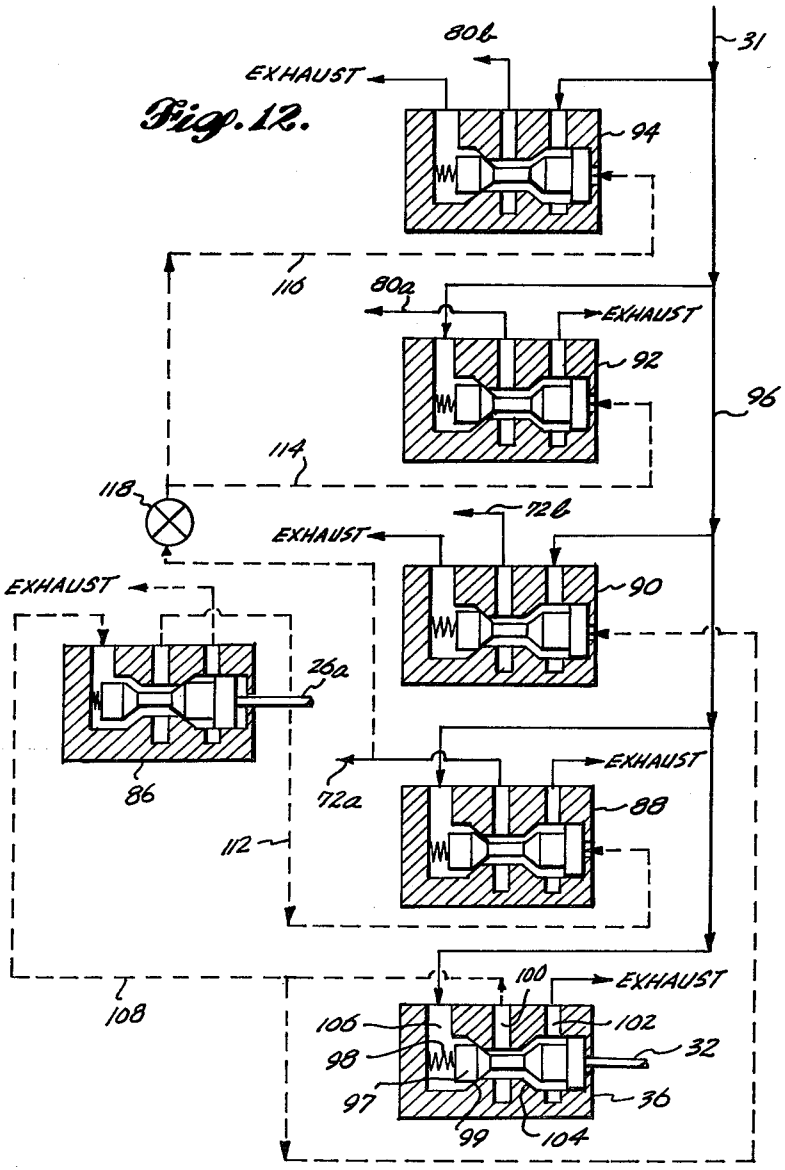

After the nail has been extracted from the workpiece, the extractor is lifted from the surface of the workpiece, causing the push rod 32 to again extend beyond the bottom of the support arm 28, which in turn returns the control spool 97 of the safety valve 36 to its first or static condition as shown in FIG. 12. When the safety valve is returned to its static condition, the pressure in the fluid control lines 110 and 108 is exhausted to the atmosphere, returning the control valve 90 to its static position and disconnecting the control pressure from the manual trigger valve 86. When the control valve 90 returns to its static position, pressurized fluid from the manifold 96 is again readmitted to the upper portion of the lower cylinder 72. After the manual force is relieved from the manual trigger, returning the manual trigger valve 86 to its static condition as shown in FIG. 9, the control pressure is relieved from control valve 88, in turn causing the spool of the control valve 88 to return to its static conditions. When control valve 88 returns to its static condition, the pressurized fluid in the lower portion of the lower cylinder 72 is exhausted to the atmosphere, allowing the piston 70 to begin its downward stroke under the urging of the pressurized fluid in the upper portion of the lower cylinder. As it returns along its downward stroke, it abuts the shoulder formed by the jaw actuation sleeve 48, reopening the jaws and releasing the nail (corresponding to FIG. 6). Control lines 114 and 116 are also exhausted to the atmosphere. However, because the restrictor 118 slowly bleeds the control fluid pressure from lines 114 and 116, the control valves 92 and 94 are not immediately returned to their static positions but do so within a short time after the manual trigger is released. As this occurs, both of the control valves 92 and 94 return to their static positions, re-exhausting the lower portion of the upper cylinder 80 and admitting pressurized fluid to the upper portion of the upper cylinder from manifold 96. As this occurs, the upper piston 78 reciprocates in its downward stroke until it abuts the partition 76. When both of the pistons 70 and 78 have returned to their static position, that is, reciprocated downwardly until they can move no further, the extraction rod and the jaw actuation sleeve are both returned to their static positions, again readying the extractor for another cycle of operation.

The present invention has been described in relation to a preferred embodiment. One of ordinary skill in the art will be able to effect various changes, substitutions of equivalents, and other alterations without departing from the broad concepts disclosed herein. For example, a variety of fluid pressure control schemes can be employed to actuate the dual pistons in a manner the same as or similar to that just described, once the general concepts of the invention disclosed herein are known. Further, one of ordinary skill will recognize that the extraction apparatus of the present invention is useful not only for pulling ordinary nails from a workpiece, but also for extracting double headed nails, corrugated fasteners, and other articles that are at least partially embedded in a workpiece. It is therefore intended that the protection granted by Letters Patent hereon be limited only to the definition contained in the appended claims and equivalents thereof.

I claim:

1. An apparatus for extracting an article at least partially embedded in a workpiece comprising:

a support member;

a pulling member mounted on said support member for reciprocating movement toward and away from said workpiece when said support member is operably positioned adjacent said workpiece;

first and second jaws mounted on said pulling member for swinging movement between a first position in juxtaposed relationship adjacent an article to be extracted from said workpiece when said member is positioned against said workpiece and a second position remote from said article;

jaw actuation means including a movable member operatively associated with said jaws for moving said jaws between said first and said second positions and first drive means operatively coupled to said movable member for translating said movable member from said second position to said first position, said first drive means and said movable member being constructed and associated with each other so that said first drive means first impacts said movable member to swing said jaws toward said workpiece, to cause said jaws to penetrate said workpiece, and thereafter to cause said jaws to grip said article; and second drive means for driving said pulling member away from said workpiece after said jaws grip said article, said first drive means causing said jaws to maintain a grip on said article as said second means draws said pulling member.

2. The apparatus of claim 1 wherein said movable member comprises a jaw actuation member reciprocally mounted on said support member, said first drive means for driving said movable member away from said workpiece to cause said jaws to move to said first position from said second position.

3. The apparatus of claim 1 wherein said first drive means comprises a first fluid actuatable piston mounted in a first cylinder associated with said support member, said first piston being operatively coupled to said movable member, said apparatus further comprising control means for actuating said first piston for movement away from said jaws to move said movable member and close said jaws about said article.

4. The apparatus of claim 3 wherein said second drive means for driving said pulling member comprises a second fluid actuatable piston mounted in a second cylinder, said second piston being so constructed to operatively reciprocate said pulling member, said control means actuating said piston and said pulling member for movement away from said workpiece after actuating said first piston, thereby removing said article from said workpiece.

5. The apparatus of claim 1 further comprising control means for sequentially actuating said jaw actuation means and said second drive means in response to a first manually initiated signal to first cause said jaw actuation means to move said jaws from said second to said first position and thereafter to cause said drive means to reciprocate said pulling member away from said workpiece.

6. The apparatus of claim 5 wherein said control means, after said jaws are in said second position and said pulling member is moved away from said workpiece, in further response to a second manually initiated signal causes said jaw actuation means to move said jaws from said first to said second position and thereafter causes said second drive means to reciprocate said pulling member toward said workpiece.

7. The apparatus of claim 1 wherein said first drive means after moving said jaws to said first position assists said second drive means in driving said pulling member away from said workpiece.

8. An apparatus for extracting an article at least partially embedded in a workpiece comprising:

a support member;

a pulling member mounted on said support member for reciprocating movement toward and away from said workpiece when said support member is operably positioned adjacent said workpiece, said pulling member including a pulling rod that extends away from said workpiece;

first and second jaws mounted on said pulling member for swinging movement between a first position in juxtaposed relationship adjacent an article to be extracted from said workpiece when said support member is positioned against said workpiece and a second position remote from said article;

jaw actuation means for moving said jaws between said first and said second positions, and said jaw actuation means including a sleeve mounted coaxially with said pulling member for reciprocating movement toward and away from said workpiece, connection means for connecting each of said jaws to said sleeve such that said jaws will swing to said first position when said sleeve moves away from said workpiece; and drive means for driving said sleeve away from said workpiece; and drive means for driving said pulling member away from said workpiece.

9. The apparatus of claim 8 wherein said drive means for driving said sleeve comprises a first fluid actuatable piston mounted in a first cylinder operably associated with said support member.

10. The apparatus of claim 9 wherein said sleeve extends into said first cylinder and has first and second longitudinally spaced abutments along its outer surface in said first cylinder, said first piston being slidably mounted along the jaw actuation sleeve between said abutments.

11. The apparatus of claim 10 wherein said drive means for driving said pulling member comprises a second fluid actuatable piston mounted in a second cylinder associated with said support member, and means for operably fixing said second piston to said pulling rod.

12. The apparatus of claim 9 wherein said drive means for driving said pulling member comprises a second fluid actuatable piston mounted in a second cylinder associated with said support member, and means for operably affixing said second piston to said pulling rod.

13. The apparatus of claim 12 further comprising control means for actuating said first piston for movement away from said jaws to move said sleeve away from said jaws and thus close said jaws about said article and for actuating said second piston to move said pulling rod away from said workpiece after actuating said first piston, thereby removing said article from said workpiece.

14. The apparatus of claim 13 wherein said control means comprises:

first fluid valve means for exhausting one end of said first cylinder when in a first condition and for admitting fluid under pressure to said one end of the first cylinder when in a second condition;

second fluid valve means for admitting fluid under pressure to the other end of said first cylinder when in a first condition and for exhausting said other end of said first cylinder when in a second condition;

third fluid valve means for exhausting one end of said second cylinder when in a first condition and for admitting fluid under pressure to said one end of said second cylinder when in a second condition;

fourth fluid valve means for admitting fluid under pressure to the other end of said second cylinder when in a first condition and for exhausting said other end of said second cylinder when in a second condition;

means for operatively coupling said first, second, third and fourth valve means to a source of fluid under pressure;

each of said valve means being in its first condition before operation of said apparatus;

means for moving said second valve means to its second condition and means for moving said first valve means to its second condition such that said fluid under pressure drives said first piston away from said jaws; and means for moving said third and fourth valve means into their second conditions after said first piston is driven away from said jaws, such that said fluid under pressure drives said second piston away from said workpiece.

15. The apparatus of claim 14 further comprising first and second trigger valve means, said first trigger valve means being operatively coupled to said source of fluid pressure and being operatively coupled by a first fluid control line to said second fluid valve means and said second trigger valve means, said second trigger valve means being operatively coupled by a second fluid control line to said first fluid valve means, said first trigger valve means exhausting said first fluid control line to said second trigger valve means and to said second fluid valve means when in a first condition, and admitting fluid under pressure to said first fluid control line when in a second condition;

said second trigger valve means exhausting said second fluid control line to said first fluid valve means and connecting said second fluid control line to said first fluid control line when in a second condition;

said third and fourth fluid valve means being operatively coupled by a third fluid control line to receive fluid from said first fluid valve means when said first fluid valve means is in said second condition; said third fluid control line including a restriction for delaying response of said second and third fluid valve means;

said second fluid valve means moving to said second condition when fluid pressure is applied to said first fluid control line and returning to said first condition when said first fluid control line is exhausted;

said first fluid valve means moving to said second condition when fluid pressure is applied to said second fluid control line through said second trigger valve means and returning to said first condition when said second fluid control line is exhausted;

said third and fourth fluid valve means moving to their respective second conditions when pressure is applied to said third fluid control line and returning to their respective first conditions when said third fluid control line is exhausted.

16. The apparatus of claim 8 wherein said drive means for driving said sleeve is an impact drive.

17. An apparatus for extracting an article at least partially embedded in a workpiece comprising:

a support member;

a pulling member mounted on said support member for reciprocating movement toward and away from said workpiece when said support member is operably positioned adjacent said workpiece;

first and second jaws mounted on said pulling member for swinging movement between a first position in juxtaposed relationship adjacent an article to be extracted from said workpiece when said support member is positioned against said workpiece and a second position remote from said article;

jaw actuation means for moving said jaws between said first and second positions, said jaw actuation means including a jaw actuation member reciprocally mounted on said support member and jaw drive means for driving said jaw actuation member away from said workpiece, said jaw actuation member having first and second longitudinally spaced abutments thereon, and said jaw drive means including a first fluid actuatable piston mounted in a first cylinder, said first piston being slidable along said jaw actuation member between said first and second abutments; said apparatus further comprising control means for actuating said first piston for movement away from said jaws and to impact against one of said abutments to move said jaw actuation member away from said jaws and thus close said jaws about said article; and drive means for driving said pulling member away from said workpiece.

18. The apparatus of claim 17 wherein said drive means for driving said pulling member comprises a second fluid actuatable piston mounted in a second cylinder, said second piston being fixed to said pulling member; and wherein said control means actuates said second piston and thus said pulling member for movement away from said workpiece after actuating said first piston, thereby removing said article from said workpiece.

19. The apparatus of claim 18 wherein said control means comprises:

first fluid valve means for exhausting one end of said first cylinder when in a first condition and for admitting fluid under pressure to said one end of the first cylinder when in a second condition;

second fluid valve means for admitting fluid under pressure to the other end of said first cylinder when in a first condition and for exhausting said other end of said first cylinder when in a second condition;

third fluid valve means for exhausting one end of said second cylinder when in a first condition and for admitting fluid under pressure to said one end of said second cylinder when in a second condition;

fourth fluid valve means for admitting fluid under pressure to the other end of said second cylinder when in a first condition and for exhausting said other end of said second cylinder when in a second condition;

means for operatively coupling said first, second, third and fourth valve means to a source of fluid pressure;

each of said valve means being in its first condition before operation of said apparatus;

means for moving said second valve means to its second condition and means for moving said first valve means to its second condition such that said fluid under pressure drives said first piston away from said jaws; and means for moving said third and fourth valve means into their second conditions after said first piston is driven away from said jaws, such that said fluid under pressure drives said second piston away from said workpiece.

20. The apparatus of claim 19 further comprising first and second trigger valve means, and first trigger valve means being operatively coupled to said source of fluid pressure and being operatively coupled by a first fluid control line to said second fluid valve means and said second trigger valve means, said second trigger valve means being operatively coupled by a second fluid control line to said first fluid valve means, said first trigger valve means exhausting said first fluid control line to said second trigger valve means and to said second fluid valve means when in a first condition and admitting fluid under pressure to said first fluid control line when in a second condition, said second trigger valve means exhausting said second fluid control line to said first fluid valve means and connecting said second fluid control line to said first fluid control line when in a second condition, said third and fourth fluid valve means being operatively coupled by a third fluid control line to receive fluid from said first fluid valve means when said first fluid valve means is in said second condition, said third fluid control line including a restriction for delaying response of said second and third fluid valve means, said second fluid valve means moving to said second condition when fluid pressure is applied to said first fluid control line and returning to said first condition when said first fluid control line is exhausted said first fluid valve means moving to said second condition when fluid pressure is applied to said second fluid control line through said second trigger valve means and returning to said first condition when said second fluid control line is exhausted, said third and fourth fluid valve means moving to their respective second conditions when pressure is applied to said third fluid control line and returning to their respective first conditions when said third fluid control line is exhausted.

21. An apparatus for extracting an article at least partially embedded in a workpiece comprising:

a support member;

a pulling member mounted on said support member for reciprocating movement tward and away from said workpiece when said support member is operably positioned adjacent said workpiece;

first and second jaws mounted on said pulling member for swinging movement between a first position in juxtaposed relationship adjacent an article to be extracted from said workpiece when said support member is positioned against said workpiece and a second position remote from said article;

jaw actuation means for moving said jaws between said first and second positions;

drive means for driving said pulling member away from said workpiece; and control means for sequentially actuating said jaw actuation means and said drive means in response to a first manually initiated signal to first cause said jaw actuation means to move said jaws from said first position and thereafter cause said drive means to reciprocate said pulling member away from said workpiece, said control means including a safety valve means for placing said control means in a deactivated condition and an activated condition, said safety valve means placing said control means in an activated position when said support member is positioned against said workpiece.

22. The apparatus of claim 21 wherein the bottom of said support member is abutted against said workpiece when said apparatus is positioned to extract an article from said workpiece, said apparatus further comprising a push rod reciprocally mounted in relation to said support member and operably connected to said safety valve means, said push rod normally extending beyond the bottom of said support member to cause said safety valve means to place said control means in a deactivated condition, said push rod moving to a second position to cause said safety valve means to place said control means in an activated condition when said support member is positioned against said workpiece.

23. A nail extractor for extracting nails from a workpiece comprising:

a support member;

a nail pulling rod reciprocally mounted with respect to said support member;

first and second jaws pivotally mounted to said nail pulling rod such that said jaws are positionable adjacent a nail embedded in said workpiece when said support member is positioned against said workpiece;

a jaw actuation sleeve coaxial with said nail pulling rod and reciprocally mounted with respect to said support member and said nail pulling rod, said jaw actuation sleeve having first and second longitudinally spaced abutments;

connecting links connecting each of said jaws to said jaw actuation sleeve such that said jaws will pivot and thereby close about said nail when said jaw actuation sleeve moves in a direction away from said jaws;

a first fluid actuatable piston mounted in a first cylinder associated with said support member, said first piston being slidable along said jaw actuation sleeve between said abutments;

a second fluid actuatable piston mounted in a second cylinder associated with said support member, said second piston being fixed to said nail pulling rod; and control means for actuating said first piston for movement away from said jaws and to impact against one of said abutments to cause movement of said jaw actuation sleeve and thus close said jaws about said nail and for actuating said second piston and said nail pulling rod for movement away from said workpiece after actuating said first piston, thereby removing said nail from said workpiece.

24. The nail extractor of claim 23 wherein said control means comprises:

first fluid valve means for exhausting one end of said first cylinder when in a first condition and for admitting fluid under pressure to said one end of the first cylinder when in a second condition;

second fluid valve means for admitting fluid under pressure to the other end of said first cylinder when in a first condition and for exhausting said other end of said first cylinder when in a second condition;

third fluid valve means for exhausting one end of said second cylinder when in a first condition and for admitting fluid under pressure to said one end of said second cylinder when in a second condition;

fourth fluid valve means for admitting fluid under pressure to the other end of said second cylinder when in a first condition and for exhausting said other end of said second cylinder when in a second condition;

means for operatively coupling said first, second, third and fourth valve means to a source of fluid under pressure;

each of said valve means being in its first condition before operation of said nail extractor;

means for moving said second valve means to its second condition and means for moving said first valve means to its second condition such that said fluid under pressure drives said first piston away from said jaws; and means for moving said third and fourth valve means into their second conditions after said first piston is driven away from said jaws, such that said fluid under pressure drives said second piston away from said workpiece.

25. The nail extractor of claim 23 further comprising first and second trigger valve means, said first trigger valve means being operatively coupled to said source of fluid pressure and being operatively coupled by a first fluid control line to said second fluid valve means and said second trigger valve means, said second trigger valve means being operatively coupled by a second fluid control line to said first fluid valve means, said first trigger valve means exhausting said first fluid control line to said second trigger valve means and to said second fluid valve means when in a first condition, and admitting fluid under pressure to said first fluid control line when in a second condition;

said second trigger valve means exhausting said second fluid control line to said first fluid valve means and connecting said second fluid control line to said first fluid control line when in a second condition;

said third and fourth fluid valve means being operatively coupled by a third fluid control line to receive fluid from said first fluid valve means when said first fluid valve means is in said second condition;

said third fluid control line including a restriction for delaying response of said second and third fluid valve means;

said second fluid valve means moving to said second condition when fluid pressure is applied to said first fluid control line and returning to said first condition when said first fluid control line is exhausted;

said first fluid valve means moving to said second condition when fluid pressure is applied to said second fluid control line through said second trigger valve means and returning to said first condition when said second fluid control line is exhausted;

said third and fourth fluid valve means moving to their respective second conditions when pressure is applied to said third fluid control line and returning to their respective first conditions when said third fluid control line is exhausted.

* * * * *

UNITED STATES PATENT AND TRADEMARK OFFICE

CERTIFICATE OF CORRECTION

PATENT NO. : 4,078,766

DATED : March 14, 1978

INVENTOR(S) : Albert C. Saurwein

It is certified that error appears in the above-identified patent and that said Letters Patent are hereby corrected as shown below:

Column 2, line 68: "de" is deleted.

Column 4, line 1: "extrcted" is changed to —extracted—.

Column 8, line 66: —support— is inserted before "member".

Column 13, line 48: "tward" is changed to —toward—.

Column 15, line 21: "23" is changed to —24—.

Signed and Sealed this

*Eighth* Day of *August 1978*

[SEAL]

*Attest:*

RUTH C. MASON
*Attesting Officer*

DONALD W. BANNER
*Commissioner of Patents and Trademarks*